US009055793B2

(12) United States Patent
Jansen

(10) Patent No.: US 9,055,793 B2
(45) Date of Patent: Jun. 16, 2015

(54) SHOTGUN SHELL JEWELRY AND METHOD THEREFOR

(71) Applicant: Anne Jansen, Marthasville, MO (US)

(72) Inventor: Anne Jansen, Marthasville, MO (US)

( * ) Notice: Subject to any disclaimer, the term of this patent is extended or adjusted under 35 U.S.C. 154(b) by 0 days.

(21) Appl. No.: 13/911,624

(22) Filed: Jun. 6, 2013

(65) Prior Publication Data

US 2013/0327091 A1 Dec. 12, 2013

Related U.S. Application Data

(60) Provisional application No. 61/657,311, filed on Jun. 8, 2012.

(51) Int. Cl.
*A44C 27/00* (2006.01)
*A44C 25/00* (2006.01)

(52) U.S. Cl.
CPC ..... *A44C 27/001* (2013.01); *A44C 25/00* (2013.01); *Y10T 156/1062* (2015.01); *Y10T 29/4959* (2015.01); *A44C 27/003* (2013.01)

(58) Field of Classification Search
CPC ..... Y10T 29/49716; A44C 27/001; A44C 27/002; A44C 27/003; A44C 25/00; A44C 27/00
See application file for complete search history.

(56) References Cited

U.S. PATENT DOCUMENTS 1,804,833 A * 5/1931 Johnston ..... 63/36
2,599,660 A * 6/1952 Poutinen ..... 24/601.6
4,349,951 A * 9/1982 Wefler ..... 29/401.1
4,569,472 A 2/1986 Zettl
4,766,659 A * 8/1988 Cronenwett et al. ..... 29/401.1
5,471,830 A 12/1995 Gonzales
5,479,796 A * 1/1996 Shimano ..... 63/33
5,594,989 A 1/1997 Greve
D383,698 S * 9/1997 Fletcher ..... D11/40
5,896,663 A 4/1999 Greve
6,383,248 B1 5/2002 Taylor
6,668,608 B1 * 12/2003 Derman ..... 70/456 R
D505,636 S * 5/2005 Bisceglie ..... D11/79
7,431,632 B2 10/2008 Kalanovic
D652,477 S * 1/2012 Klement ..... D22/115
8,127,568 B2 3/2012 Sobchenko
8,661,849 B2 * 3/2014 Fischer ..... 63/36
D705,693 S * 5/2014 Thompson ..... D11/41
D714,181 S * 9/2014 Thompson ..... D11/43

(Continued)

OTHER PUBLICATIONS

Recycling Bullet Casings into Jewelry [online]. Craftside, Sep. 10, 2008. Retrieved from the Internet: <URL:www.craftside.typepad.com/craftside/2008/09/recycling-bulle.html>.

(Continued)

*Primary Examiner* — David Bryant
*Assistant Examiner* — Jason L Vaughan
(74) *Attorney, Agent, or Firm* — CreatiVenture Law, LLC; Dennis J M Donahue, III

(57) ABSTRACT

The present invention includes a method of manufacturing a shotgun cartridge for use with jewelry, wherein the method includes cutting off a portion of the brass head of a shotgun cartridge with a lathe. The portion of the brass head of the cartridge has a primer extending from a back side of that portion of the brass head of the cartridge. The primer is cut from the back side of that portion with a high speed drill having a cutting blade positioned thereon. The back side of that portion is then filed to create a smooth surface that may be secured to a mounting surface of a jewelry setting.

20 Claims, 3 Drawing Sheets

(56) References Cited

U.S. PATENT DOCUMENTS

| | | | | |
|---|---|---|---|---|
| 2004/0206113 | A1* | 10/2004 | Coughlin | 63/1.16 |
| 2005/0056052 | A1* | 3/2005 | Lawrence | 63/1.16 |
| 2006/0013718 | A1 | 1/2006 | Anderson | |
| 2008/0041099 | A1 | 2/2008 | Hirate | |
| 2014/0072781 | A1* | 3/2014 | Holc | 428/195.1 |

OTHER PUBLICATIONS

Shotgun shell jewelry[online]. Sweater Surgery, Sep. 10, 2008. Retrieved from the Internet: <URL:www.sweatersurgery.blogspot.com/search/label/shotgun shell jewelry>.

* cited by examiner

SHOTGUN SHELL JEWELRY AND METHOD THEREFOR

CROSS-REFERENCE TO RELATED APPLICATIONS

This application claims priority from U.S. Provisional Patent Application No. 61/657,311 filed on Jun. 8, 2012 which is hereby incorporated by reference.

STATEMENT REGARDING FEDERALLY SPONSORED RESEARCH

Not Applicable.

APPENDIX

Not Applicable.

BACKGROUND OF THE INVENTION

1. Field of the Invention

The present invention relates to jewelry, and more particularly to a method of manufacturing an article of jewelry with a spent shotgun shell cartridge and to the article of jewelry incorporating the spent shotgun shell cartridge.

2. Related Art

Using recycled goods to create jewelry is generally well known. Some jewelry includes bullet casings, for example, shotgun cartridges. However, utilizing an entire shotgun cartridge may result in the jewelry being bulky and or heavy. Accordingly, it is desired to create jewelry that incorporates a portion of the head of the cartridge in a way that reduces the profile of the casing to be less than the full cartridge head. Accordingly, the casing can be cut to the desired profile width. The cartridge head includes a primer that typically extends farther than the desired thickness of the casing profile and must also be cut to be able to use the portion of the cartridge head in standard jewelry settings that have a flat base.

There are a number of methods in which the cartridge head of the shotgun shell can be cut, but the primer will become dislocated from its position in the center of the cartridge head's base. For example, the rotating action of a lathe at its standard speed and the standard cutting bit that are used to cut the cartridge casing and plastic insert, result in a disruption of the manufacturer fitted primer and compromises the primer's position. Previous methods for preparing shotgun shell cartridges for jewelry did not provide any mechanism for cutting through cartridge casing, plastic insert and the primer in a way that would preserve the primer in its original position within the cartridge. Accordingly, there has remained a need for a method whereby the end of a shotgun shell cartridge can be cut in such a way so that the resulting head can be mounted on a jewelry setting without having to reset or otherwise reconnect the primer to the cut head portion.

SUMMARY OF THE INVENTION

The present embodiment provides a method to remove a portion of the brass head of the cartridge as well as cut through the primer, so that resulting portion of the brass head may be mounted on settings for jewelry applications. In one embodiment, the method includes cutting a portion of the brass head of the cartridge with a lathe. The brass head of the cartridge has a primer that extends from a portion of the brass head, therefore, the primer is cut from the back side of the brass head of the cartridge with a high speed drill having a cutting wheel positioned thereon. The back side of the primer is then filed to create a smooth surface that may be secured to a jewelry setting, preferably a bezel.

In another embodiment, a jewelry piece is provided having a setting with a flat mounting surface and a portion of the brass head of the cartridge secured to the mounting surface of the setting, wherein the back side the brass head of the cartridge has been filed to a smooth surface that rests flush on the mounting surface of the setting.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
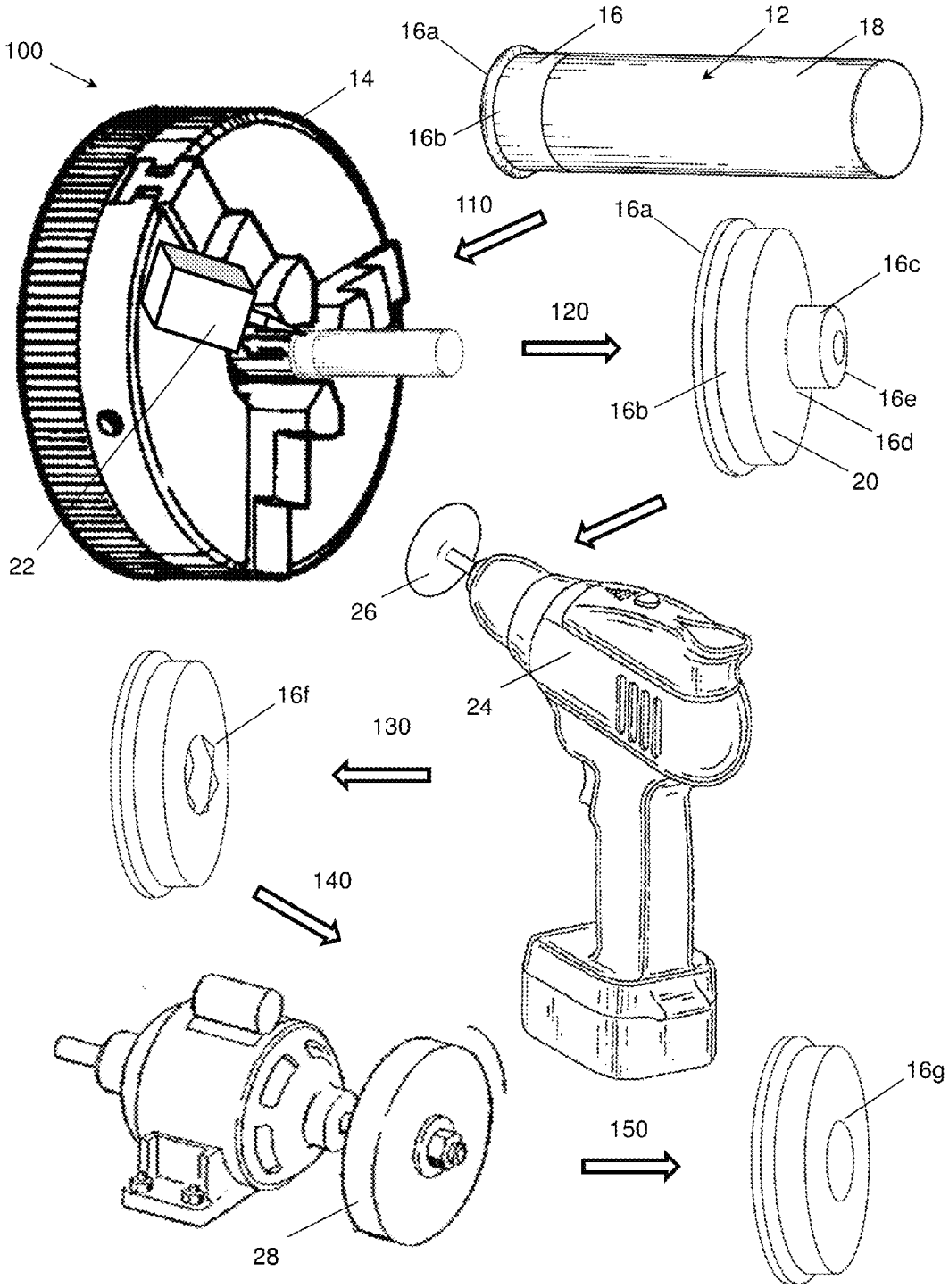
FIG. 1 shows a schematic representation of the process to prepare a shotgun shell for use in a jewelry setting.

The following description of the preferred embodiment(s) is merely exemplary in nature and is in no way intended to limit the invention, its application, or uses.

The present invention provides a method for manufacturing a shotgun cartridge 12 for use with jewelry 10. In particular, the method overcomes problems associated with removing a base portion 16*a*, 16*b* of the cartridge head 16 with a section of the primer 16*c* from the cartridge in a manner that enables the base portion to be secured to a jewelry setting 30 that is substantially flat 32, and hides the cut end of the portion of the head 16. Generally, to create a smooth surface 16*g* on the back side of the brass head 16 of the cartridge that is suitable for use with a jewelry setting 30 requires the primer 16*c* to be cut from the back side of the head. Typically, the primer cannot be removed during the same process as removing the portion of the brass head of the cartridge from the shotgun cartridge 12 because the primer may shift during such as process, thereby causing the primer to be compromised or separated completely, rendering the shell unsuitable for jewelry applications where the primer needs to remain in the portion of the brass head of the cartridge.

The manufacturing method that is shown in FIG. 1 can be used with spent shotgun cartridges 12 of any gauge (10 gauge, 12 gauge, 16 gauge, 20 gauge, 28 gauge or 410 gauge). The jewelry setting 30 is preferably a bezel setting that is sized to match the gauge of the cartridge that will be secured to the flat base 32 of the setting. A spent shotgun cartridge 12 is one that has been fired, such in a firearm, or has otherwise had the primer struck and ignited so that the cartridge no longer contains the shot, wad or gunpowder within the hull or case, but the hollow tube 18 of the hull remains intact and connected to the cartridge head 16 which holds the primer 16*c*. In an exemplary embodiment of the manufacturing process, the shotgun cartridge may be positioned in a lathe 110, for example, a mini lathe, that has been modified and equipped with a diamond carbide bit 22 or blade to give the lathe the ability to cut through a portion of the cartridge head as well as the plastic base of the hull or base wad or other filler 20 between the outer casing 16*b* of the head and the inner primer 16*c*. Once the cartridge head is cut with the lathe to the primer, the head is separated from the cartridge hull 18.

The chuck 14 of the lathe may also be modified to securely hold the lip of the shotgun cartridge 12. Modifications to the chuck may also enable the shotgun cartridge to be positioned at an appropriate distance wherein the bit can cut within millimeters from the top of the cartridge, thus controlling the width of the thickness of the resulting portion of the cartridge. The width of the profile of any cartridge is controlled by adjusting the compound rest crank. Once the cartridge is tightened into the chuck, the profile width determined, the lathe is turned on. With the shell tightened in place in the chuck, the diamond carbide bit is caused to approach the side of the casing once the lathe is operation. In an exemplary embodiment, the lathe spins at a maximum of 2500 rotations per minute, and the cross slide crank of the lathe is controlled by the lathe operator by slowly turning the crank to advance the bit toward the portion of the brass head of the cartridge and begin the cutting process. As the bit cuts through that portion and reaches the primer, the lathe is stopped and the bit is backed away from the cartridge resulting in a cartridge with the primer intact 120.

The profile width of the cut portion of the cartridge head can be adjusted to match the setting. For example, with a bezel setting that has a 1 mm ridge around the bezel base and a 2 mm offset of the cartridge rim is desired over the ridge, the cartridge head can be cut to approximately 3 mm for the profile width. In comparison, if a closer rim to ridge setting is desired, the profile width of the cartridge head can be reduced. Similarly, the profile widths can be increased to provide more clearance between the rim and ridge or to accommodate a deeper ridge to base bezel setting.

It is important to note that the lathe is preferably not utilized to cut through the primer because the rotating action of the lathe, coupled with the approach of the bit may disrupt the primer and compromise the primer's position in the center 16*d* of the casings or separated completely, rendering the shell unusable for jewelry applications where the primer needs to remain in the portion of the brass head of the cartridge. Accordingly, in the manufacturing process of the present invention, the lathe is used to cut through the casing and the inner hull or base wad but it is preferably stopped before cutting the primer.

A high speed drill 24 equipped with a cutting wheel 26 is used to cut the primer off of the portion of the brass head of the cartridge without compromising the primer 130. The high speed drill is preferably a hand drill that has speeds exceeding 2,500 rpm, preferably 5,000-35,000 rpm. Because the primer is a tube like piece that contains the igniter, the high speed drill's cutting wheel is applied around the perimeter of the primer. The cartridge head is preferably turned as the rotating cutting wheel cuts through the primer so that the cutting wheel cuts around the outside of the primer although it is also possible to cut straight through the primer with the cutting wheel. After removing the distal end 16*e* of the primer from the head portion of the cartridge, rough edges and a hollow center 16*f* remain on the back side of the primer. To smooth off the rough edges around the primer and to create a flat surface 16*g*, the cut portion of the brass head of the cartridge is pressed against a grinding stone 28, such as on a bench grinder. In one embodiment, the cut portion of the brass head of the cartridge is applied to a medium grit grinding stone. The grinding stone removes any sharp edges remaining and makes the surface of the back side of the cut portion of the brass head of the cartridge substantially flat and uniform 140. It will be appreciated that other methods of filing the cut surface to be an even flat surface can be used.

The cut portion is then cleaned and polished 150. A protective wax coating is preferably applied to the cut portion and buffed prior to using the cut portion in any jewelry application. The cut portions of the brass head of the cartridges may be cleaned using a lapidary tumbler to clean a large quantity of casings at one time. Crushed walnut combined with a liquid wax compound may be mixed in the tumbler during cleaning. The wax, in conjunction with the crushed walnut or other abrasive materials, such as silicon carbide, glass beads, plastic beads or pumice, when left in the tumbler for approximately 48 hours will clean away debris from the cut portion of the brass heads of the cartridges while also coating and polishing those portions at the same time. The resulting finish resists finger prints and tarnishing. Optionally, the cut portions of the brass head of the cartridges may be cleaned by hand using steel wool, for example grade 000 steel wool. The steel wool is used to clean the profile and the top of the cut portion of the brass head of the cartridge by rubbing the surfaces. A jewelry cloth is then used to buff the top of the brass head and to give it luster. Wax is then applied to the cartridge head surfaces. The wax is a museum quality wax that forms a micro-crystalline finish to resist finger prints and keeps brass cartridges from tarnishing.

Figure 2A:
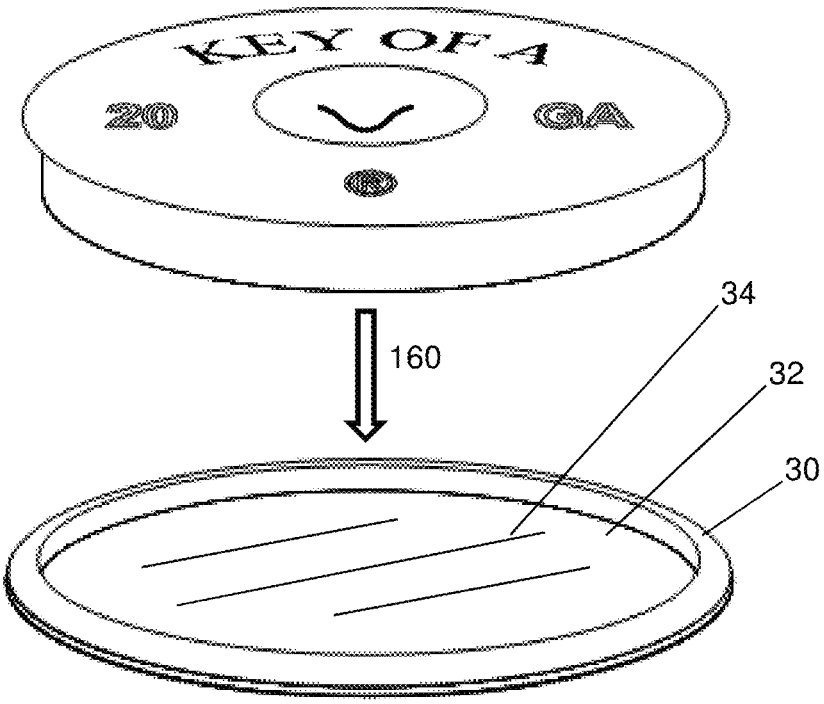
FIG. 2A shows a cut shotgun shell casing being mounted to a jewelry setting.
Figure 2B:
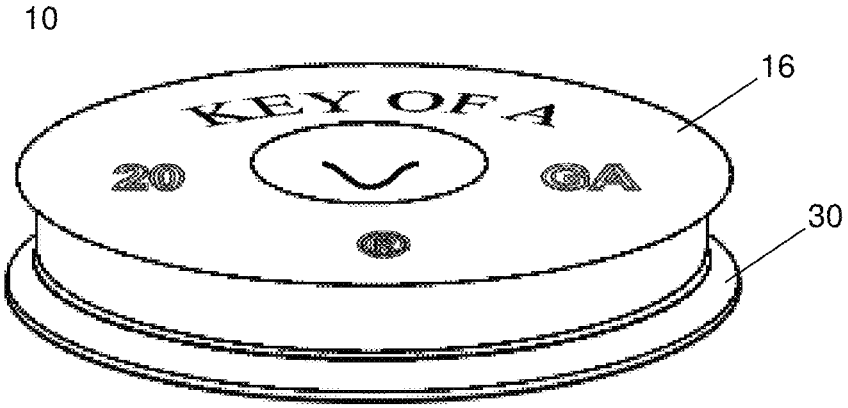
FIG. 2B shows a cut shotgun shell casing mounted in a jewelry setting.

The end result of the method described herein is a portion of the brass head of the shotgun cartridge having a substantially flat and smooth surface on the back side that may positioned on a relatively flat base setting for the jewelry piece. The cut head portions may be secured to the jewelry setting using any industrial adhesive or any other glue or epoxy 34 as shown in FIG. 2A 160. It would be difficult to solder the cartridge heads to the base setting because of the plastic filler inside the brass head of the cartridge although it may be possible to solder around the sides. In one embodiment, the primers are mounted to the jewelry setting using an E6000 adhesive. FIG. 2B illustrates the portion of the brass head of the cartridge secured within one type of jewelry setting. Various types of jewelry may include, but are not limited to, cuffs, bracelets, necklaces, earrings, money clips, or the like.

Figure 3:
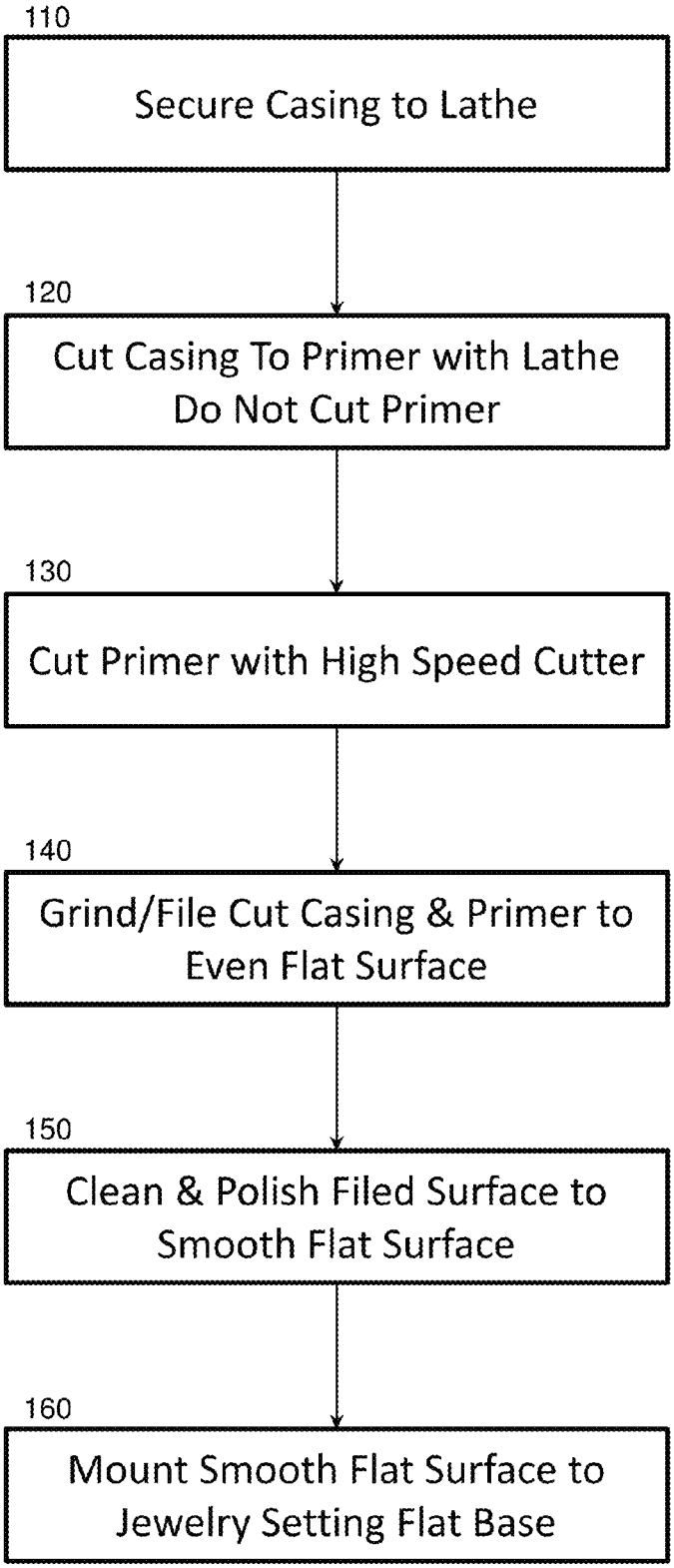
FIG. 3 shows the steps in the method for preparing and mounting the shotgun shell cartridge with a jewelry setting.

It should be noted that, in one embodiment, the cartridges may be cut and prepared for jewelry pieces using the steps described above, but may not require the primer remain in the center of the portion of the brass head of the cartridge, thus no required use of the high speed drill. Accordingly, the portion of the brass head of the cartridge may be used in jewelry without the primer and be replaced with an adornment in the center where the primer once was housed, such as a jewel, bead or any other decorative item. Optionally, the portion of the brass head of the cartridge primer may be mounted on a setting with the primer intact. The steps in the process of the present invention are provided in FIG. 3.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A method of manufacturing an article of jewelry comprising:

securing a spent shotgun shell cartridge in a chuck of a lathe, wherein said cartridge is comprised of a head section and an elongated tube section, wherein said head section comprises a circular metal base, a cylindrical metal casing extending from a periphery of said metal base, a central primer extending from a center of said metal base within said cylindrical casing to a distal end, and a plastic filler between said cylindrical metal casing and said central primer;

cutting said head section with a bit as said secured cartridge is turned in said chuck of said lathe at a first speed, wherein said cut in said head section extends through said cylindrical metal casing and said plastic filler to said primer, and wherein said distal end of said primer is not cut by said bit;

cutting said distal end of said primer from said head section with a cutting wheel on a high speed drill, wherein said cutting wheel is rotated by said high speed drill at a second speed greater than said first speed of said lathe;

filing said cut head section and said cut primer to an even flat surface;

providing a jewelry setting having a flat base; and mounting said even flat surface of said cut head section to said flat base of said jewelry setting.

2. The method of claim 1, wherein said second speed is at least twice said first speed.

3. The method of claim 2, wherein said first speed is less than approximately 2500 revolutions per minute and wherein said second speed is greater than approximately 5000 revolutions per minute.

4. The method of claim 1, wherein said filing step is performed by placing said cut head section and said cut primer against a peripheral surface of a grinding wheel.

5. The method of claim 1, wherein said mounting step is comprised of adhering said even flat surface to said flat base with an epoxy between said even flat surface and said flat base.

6. The method of claim 5, wherein said jewelry setting further comprises a ridge around a periphery of said flat base, wherein said cylindrical metal casing fits within said periphery with a close tolerance space, and wherein at least some of said epoxy fills said close tolerance space and adheres said cylindrical metal casing to said ridge.

7. The method of claim 1 further comprising the steps of cleaning said head section and polishing said head section, wherein said cleaning and polishing steps are performed before said mounting step.

8. The method of claim 7, wherein said cleaning and polishing steps are further comprised of the steps of placing a plurality of cut shotgun shell casings in a lapidary tumbler with an abrasive material and a liquid wax.

9. The method of claim 7, wherein said cleaning and polishing steps are further comprised of the steps of rubbing said even flat surface and said cylindrical metal casing with steel wool and wiping wax on said circular metal base, said cylindrical metal casing, and said even flat surface with a cloth.

10. The method of claim 1, further comprising the step of replacing said primer with a decorative adornment before said mounting step.

11. A method of manufacturing an article of jewelry comprising:

providing a spent shotgun shell, wherein said cartridge is comprised of a head section and an elongated tube section;

making a first cut in said head section with a tool operating at a first rotational speed;

filing said cut head section to an even flat surface;

cleaning said head section;

polishing said head section;

providing a jewelry setting having a flat base; and mounting said even flat surface of said cut head section to said flat base of said jewelry setting.

12. The method of claim 11, further comprising the step of making a second cut in said head section with a tool operating at a second rotational speed, wherein said second cut is deeper in said head section than said first cut and wherein said second rotational speed is at least twice said first rotational speed.

13. The method of claim 12, further comprising the steps of:

securing said head section of said shell cartridge in a chuck of a lathe, wherein said head section is comprised of a circular metal base, a cylindrical metal casing extending from a periphery of said metal base, a central primer extending from a center of said metal base within said cylindrical casing to a distal end, and a plastic filler between said cylindrical metal casing and said central primer, wherein said lathe is said tool operating at said first rotational speed, and wherein said first cut in said head section extends through said cylindrical metal casing and said plastic filler to said primer, and wherein said distal end of said primer is not cut by said first cut; and removing said head section from said chuck before making said second cut, wherein said second cut extends through said distal end of said primer and is made by a cutting wheel on a high speed drill.

14. The method of claim 12, wherein said first speed is less than approximately 2500 revolutions per minute and wherein said second speed is greater than approximately 5000 revolutions per minute.

15. The method of claim 11, further comprising the step of replacing said primer with a decorative adornment before said mounting step.

16. The method of claim 15, wherein said cleaning and polishing steps are further comprised of the steps of placing a plurality of cut shotgun shell casings in a lapidary tumbler with an abrasive material and a liquid wax.

17. A method of manufacturing an article of jewelry piece, comprising:

providing a jewelry setting having a substantially flat base;

cutting an end portion of a spent shotgun shell cartridge, wherein said cartridge is comprised of a head section and an elongated tube section, wherein said head section comprises a circular metal base, a cylindrical metal casing extending from a periphery of said metal base, a central primer extending from a center of said metal base within said cylindrical casing to a distal end, and a plastic filler between said cylindrical metal casing and said central primer, wherein said end portion of said shotgun shell is comprised of a profile section extending from said metal base to a substantially parallel cut surface extending entirely through said cylindrical metal casing, said plastic filler material and said distal end of said primer;

filing said parallel cut surface of said end portion to a smooth surface; and securing said end portion to said substantially flat base with a layer of epoxy between said smooth cut surface of said end portion and said flat base of said jewelry setting.

18. The method of claim 17, wherein said cutting step is further comprised of making a first cut through said cylindrical metal casing with a lathe and said plastic filler material and making a second cut through said distal end of said primer with a high speed cutting wheel.

19. The method of claim 18, wherein said jewelry setting further comprises a ridge around a periphery of said flat base, wherein said cylindrical metal casing fits within said periphery with a close tolerance space, and wherein at least some of said epoxy fills said close tolerance space and adheres said cylindrical metal casing to said ridge.

20. The method of claim 17, further comprising the steps of removing said primer from said center of said metal base and mounting a decorative adornment in said center of said metal base.

* * * * *